US005370564A

United States Patent [19]

Fujimoto et al.

[11] Patent Number: 5,370,564

[45] Date of Patent: Dec. 6, 1994

[54] OUTBOARD MOTOR

[75] Inventors: Hiroaki Fujimoto; Yoshikazu Nakayasu, both of Hamamatsu, Japan

[73] Assignee: Sanshin Kogyo Kabushiki Kaisha, Hamamatsu, Japan

[21] Appl. No.: 53,165

[22] Filed: Apr. 27, 1993

[30] Foreign Application Priority Data

May 18, 1992 [JP] Japan ..... 4-148976

[51] Int. Cl.[5] ..... B63H 21/32

[52] U.S. Cl. ..... 440/89; 440/900; 440/53

[58] Field of Search ..... 440/53-58, 440/88, 89, 900, 77, 76, 78; 123/195 P; 60/310; 181/251, 268

[56] References Cited

U.S. PATENT DOCUMENTS

| | | | |
|---|---|---|---|
| 2,900,947 | 8/1959 | Cotal | 440/58 |
| 3,195,521 | 7/1965 | Larsen | 440/900 |
| 3,692,006 | 9/1972 | Miller et al. | 440/900 |
| 3,911,853 | 10/1975 | Strang | 440/89 |
| 4,371,348 | 2/1983 | Blanchard | 440/77 |

*Primary Examiner*—Edwin L. Swinehart

*Attorney, Agent, or Firm*—Knobbe, Martens, Olson & Bear

[57] ABSTRACT

An outboard motor having a power head in which an exhaust expansion chamber is provided that receives the exhaust gases from the engine and delivers them to an underwater exhaust gas discharge. The expansion chamber is affixed to the engine and forms at least in part a closure for an exhaust manifold formed integrally in the engine cylinder block.

20 Claims, 3 Drawing Sheets

OUTBOARD MOTOR

BACKGROUND OF THE INVENTION

This invention relates to an outboard motor and more particularly to an improved exhaust system for an outboard motor.

As is well known, outboard motors present a number of design difficulties because of their very basic nature and their compact construction. The exhaust gas treatment of the powering internal combustion engines is one of the areas where there are substantial design constraints. For example, it is generally the practice to discharge the exhaust gases from the engine through an underwater exhaust gas discharge at least when traveling at high speeds so as to utilize the body of water in which the watercraft is operating as a silencing medium. However, the mere provision of an underwater exhaust gas discharge will not provide the requisite amount of silencing.

It has, therefore, been the practice to deliver the exhaust gases from the engine, which is mounted in the power head, to an expansion chamber formed in the driveshaft housing via one or more exhaust pipes. However, the provision of the expansion chamber in the driveshaft housing has a number of problems. First, the expansion chamber must have sufficient volume in order to be effective and if this sufficient volume is provided, the driveshaft housing tends to become bulky. This provides a significant problem since at least a portion of the driveshaft housing is submerged and any expansion in its size will increase the drag of the outboard motor.

Furthermore, a number of other components of the propulsion system and engine support system must pass through the driveshaft housing and the discharge of the exhaust gases to an expansion chamber formed in the driveshaft housing can give rise to certain problems with respect to heat. In addition, the relatively thin wall construction of the driveshaft housing can give rise to vibrations caused by exhaust gases and the emanation of other noises from this construction.

It is, therefore, a principal object of this invention to provide an improved outboard motor construction and specifically exhaust treatment system for an outboard motor.

It is a further object of this invention to provide an improved outboard motor construction wherein the expansion chamber for the exhaust gases is formed in the power head of the outboard motor and not in the driveshaft housing.

SUMMARY OF THE INVENTION

This invention is adapted to be embodied in an outboard motor comprised of a power head consisting of an internal combustion engine having an exhaust gas outlet and a lower unit depending from said power head and having a propulsion device driven by the engine for propelling an associated watercraft. An exhaust expansion chamber is formed in the power head and receives exhaust gases from the engine exhaust gas outlet. An underwater exhaust gas discharge is formed in the lower unit for discharging exhaust gases below the level of water in which the watercraft is operating under at least some running conditions. Means deliver the exhaust gases from the exhaust expansion chamber in the power head to the underwater exhaust gas discharge.

DETAILED DESCRIPTION OF THE PREFERRED EMBODIMENT OF THE INVENTION

Figure 1:
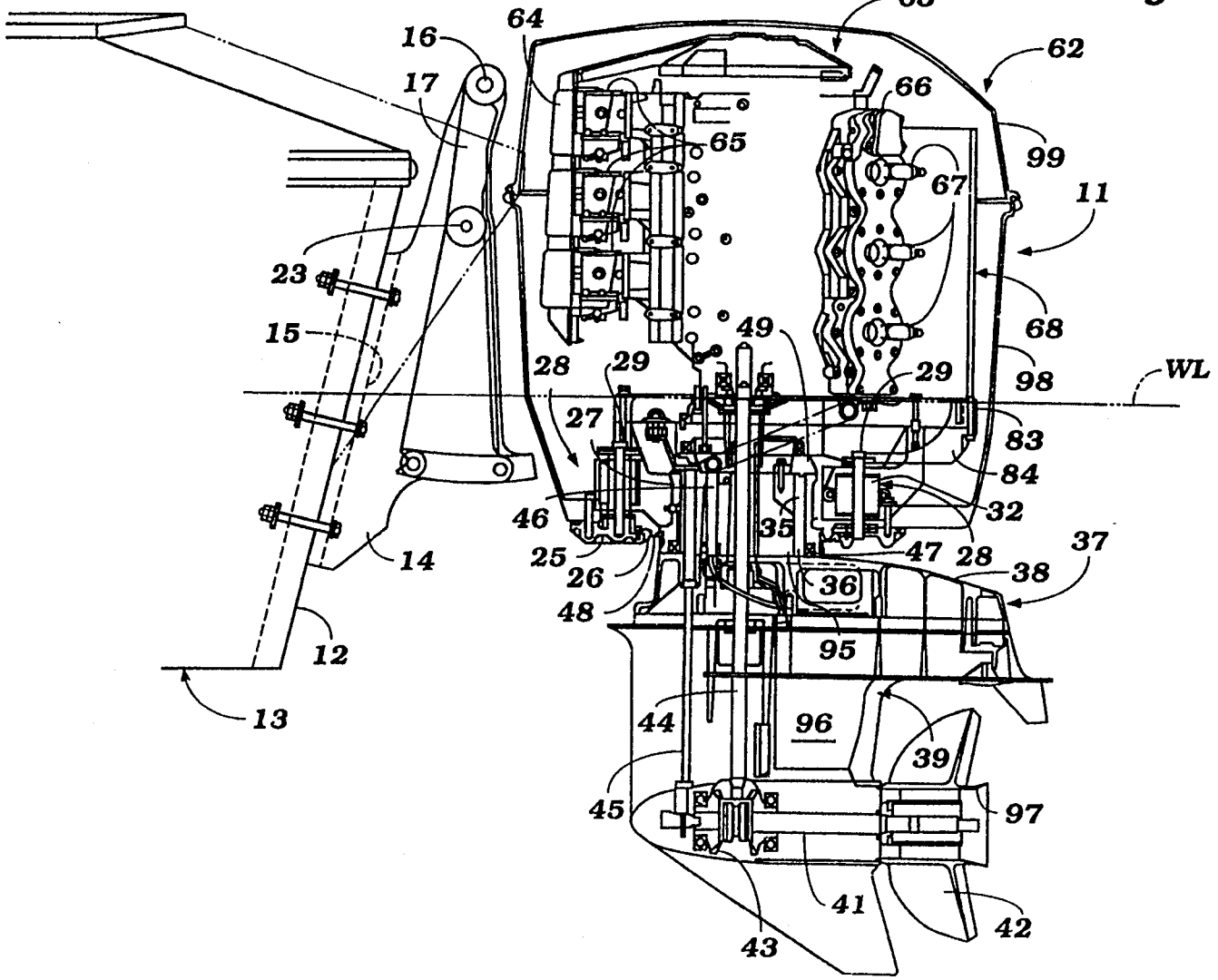
FIG. 1 is a side elevational view of the rear portion of a watercraft and powering outboard motor constructed in accordance with an embodiment of the invention, with portions broken away and other portions shown in section.

Referring now in detail to the drawings and initially, primarily to FIG. 1, an outboard motor constructed in accordance with an embodiment of the invention is identified generally by the reference numeral 11 and is depicted as being attached, in a manner to be described, to a transom 12 of an associated watercraft, shown partially and identified generally by the reference numeral 13.

Figure 2:
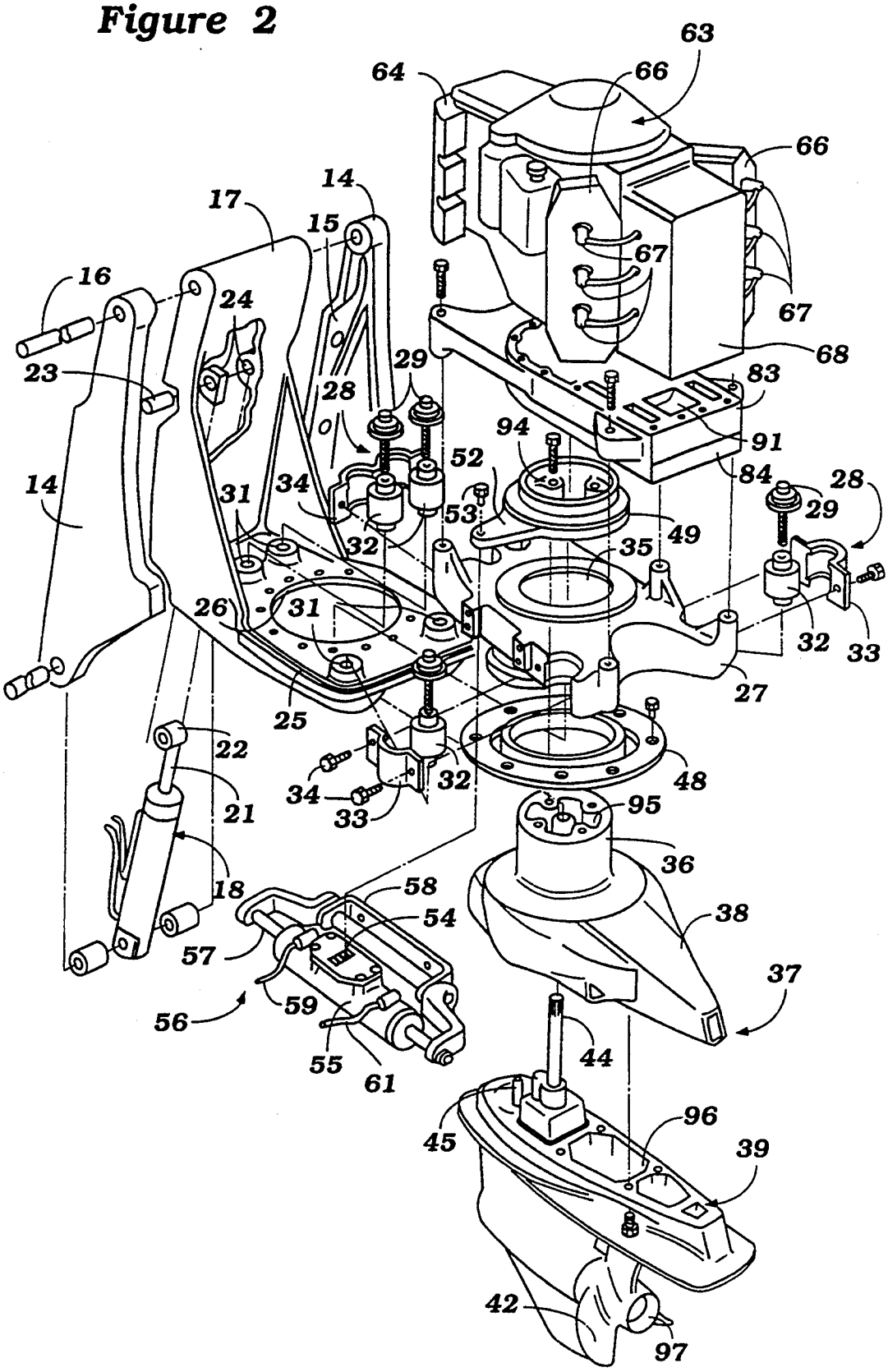
FIG. 2 is an enlarged exploded perspective view of the outboard motor, with the protective cowling removed to more clearly show the construction.

Referring now additionally to FIG. 2, the attachment arrangement for connecting the outboard motor 11 to the transom 12 includes a clamping plate assembly 14 that is comprised of a pair of spaced apart plates which have flanges 15 that are affixed to the transom 12 in a well known manner. The upper ends of the plates 14 carry pivot pins 16 which, in turn, support a supporting cradle 17 for pivotal movement about a horizontally disposed axis for tilt and trim operation. A hydraulic cylinder assembly 18 has its cylinder portion affixed for pivotal movement to the clamping brackets 14 by pivot pins 19. A piston rod 21 of the cylinder assembly 18 has a trunnion portion 22 that is pivotally connected to the cradle 17 by means of a pivot pin 23. This pivot pin 23 is received in a pair of spaced apart lugs 24 of an upstanding portion of the cradle 17. The hydraulic motor 18 may include a shock absorbing mechanism so as to permit the outboard motor 11 to pop up when an underwater obstacle is struck. In addition, the hydraulic motor assembly 18 may be energized by a suitable power source and valving arrangement for achieving tilt and trim movement of the outboard motor 11.

The cradle 17 has a generally horizontally disposed portion 25 in which an opening 26 is formed. The portion 25 is disposed so that it will be lower than the water level "WL" as indicated by the dot dash line in FIG. 1 and by the lines in FIGS. 5 and 6 when the associated watercraft 13 is in a non-planing condition. The reason for this will be readily apparent as the description proceeds. However, when the watercraft reaches a planing condition then the horizontal portion 25 of the cradle 17 will be positioned well above the water level.

A supporting plate 27 is resiliently mounted on the cradle 17 and specifically the horizontally extending portion 25 by means of a plurality of elastic isolators, indicated generally by the reference numeral 28. The elastic isolators 28 include fastening bolts 29 that are received in tapped holes formed in bosses 31 formed at spaced locations around the horizontal portion opening 26. Elastic bushings 32 are received around the threaded fasteners 29 and are held in place to the supporting plate 27 by means of clamp assemblies 33 which are, in turn, held in place by threaded fasteners 34. As a result of this mounting arrangement, the supporting plate 27 is elastically mounted on the cradle 17 so as to dampen vibrations transmitted to the cradle 17 from the propulsion device, to be described.

The supporting plate 27 is formed with a cylindrical opening 35 into which a cylindrical portion 36 of a lower unit assembly, indicated generally by the reference numeral 37 extends and is journalled. The lower unit assembly includes an upper portion 38 which may be formed from a light weight alloy casting such as aluminum or aluminum alloy and on which the cylindrical portion 36 is formed. The lower unit 37 further includes a lower assembly, indicated generally by the reference numeral 39.

A propeller shaft 41 is journaled within the lower unit housing 39 in a known manner and has a propeller 42 affixed to its outer end. A bevel gear type of reversing transmission 43 is associated with the propeller shaft 41 and it is driven by a vertically extending driveshaft 44 which is, in turn, driven, in a manner which will be described. The reversing transmission 43 selectively drives the propeller shaft 41 and propeller 42 in forward or reverse directions, as is well known in this art. A shift selector rod 45 is connected to a remote operator (not shown) in a suitable manner for shifting the transmission 43. The particular type of transmission 43 employed and its shift mechanism may be of any type known in the art.

The mounting plate 27 has a portion that extends through the opening 26 and a water tight seal 47 is interposed between the upper lower unit housing portion 36 and this depending portion so as to preclude against water leakage. In addition, a diaphragm type seal 48 is affixed to the cradle horizontal portion 25 and engages the depending portion of the mounting plate 27 so as to provide an effective water tight seal, for a reason to be described.

A steering ring 49 is affixed to the upper end of the cylindrical portion 36 of the lower unit 37 by means of threaded fasteners 51. The steering plate 49 is journaled on the upper surface of the mounting plate 27 and is provided with an outwardly extending steering arm 52. The steering arm 52 carries a pin 53 that is received in a complimentary slot 54 of a cylinder 55 of a hydraulic steering cylinder 56. The cylinder 55 has a bore in which a piston is received and this piston has a piston rod 57 that extends outwardly and which is affixed to a bracket 58 which is, in turn, affixed to the side of the mounting plate 27. A pair of hydraulic lines 59 and 61 extend to opposite sides of the cylinder assembly 55 and can be selectively pressurized and dumped under the operation of a control valve (not shown) so as to cause reciprocation of the cylinder housing 55 and rotation of the steering ring 49. This rotation is then transmitted to the lower unit 37 due to the aforedescribed connection and the propeller 42 will be rotated about a vertical steering axis, which axis is coincident with the axis of rotation of the driveshaft 44 so as to effect steering of the associated watercraft 13.

Disposed above the lower unit 37 and formed in part by the cradle 17 is a power head assembly, indicated generally by the reference numeral 62 and which power head assembly drives the driveshaft 41. This power head assembly 62 includes an internal combustion engine, indicated generally by the reference numeral 63 and which may be of any conventional type of construction, except for its exhaust system as will be hereinafter noted. In the illustrated embodiment, the engine 63 is depicted as being of the V6, two-cycle, crankcase compression type. As noted, however, the invention may be practiced with other types of engines.

The engine 63 includes an induction system comprised of an air intake device 64 that is disposed at the forward end of the power head 62 and which supplies atmospheric air to a plurality of charge formers in the form of carburetors 65. These carburetors 65 deliver the intake charge to the crankcase chambers of the engine 63 through an intake manifold which includes reed-type valves, as is well known in this art. This charge is then compressed in the crankcase chambers and delivered to the combustion chambers of the engine, formed in part by cylinder heads 66 which are affixed to the respective cylinder banks and which is fired by spark plugs 67 in a well known manner. The exhaust charge is then discharged through an exhaust manifold formed in the valley between the cylinder banks and is delivered to an exhaust silencing device, indicated generally by the reference numeral 68 and having a construction as best shown in FIGS. 3 and 4.

In conventional outboard motor construction, the exhaust silencing is achieved normally by an expansion chamber which is formed in the driveshaft housing. This has a number of disadvantages. First, in order to provide effective silencing the expansion chamber should have a substantial volume and when this expansion chamber is formed in the driveshaft housing, it will interfere with other components contained therein, such as the coolant supply for the engine, the driveshaft and bearings therefor, the water pump and various other components. Also, it is desirable to keep the configuration of the driveshaft housing as small and narrow as possible so as to reduce drag in the water. In accordance with the illustrated embodiment, the exhaust silencing device 68, which forms primarily an expansion chamber, is provided in the power head of the outboard motor.

Figure 4:
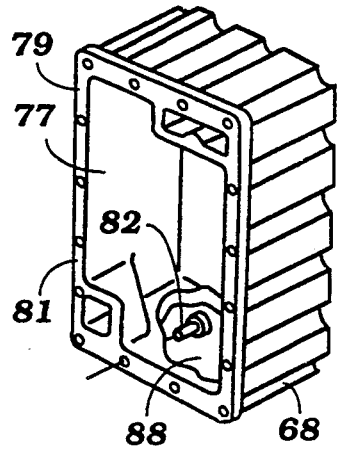
FIG. 4 is a perspective view looking in the direction of the arrow 4 in FIG. 3.
Figure 3:
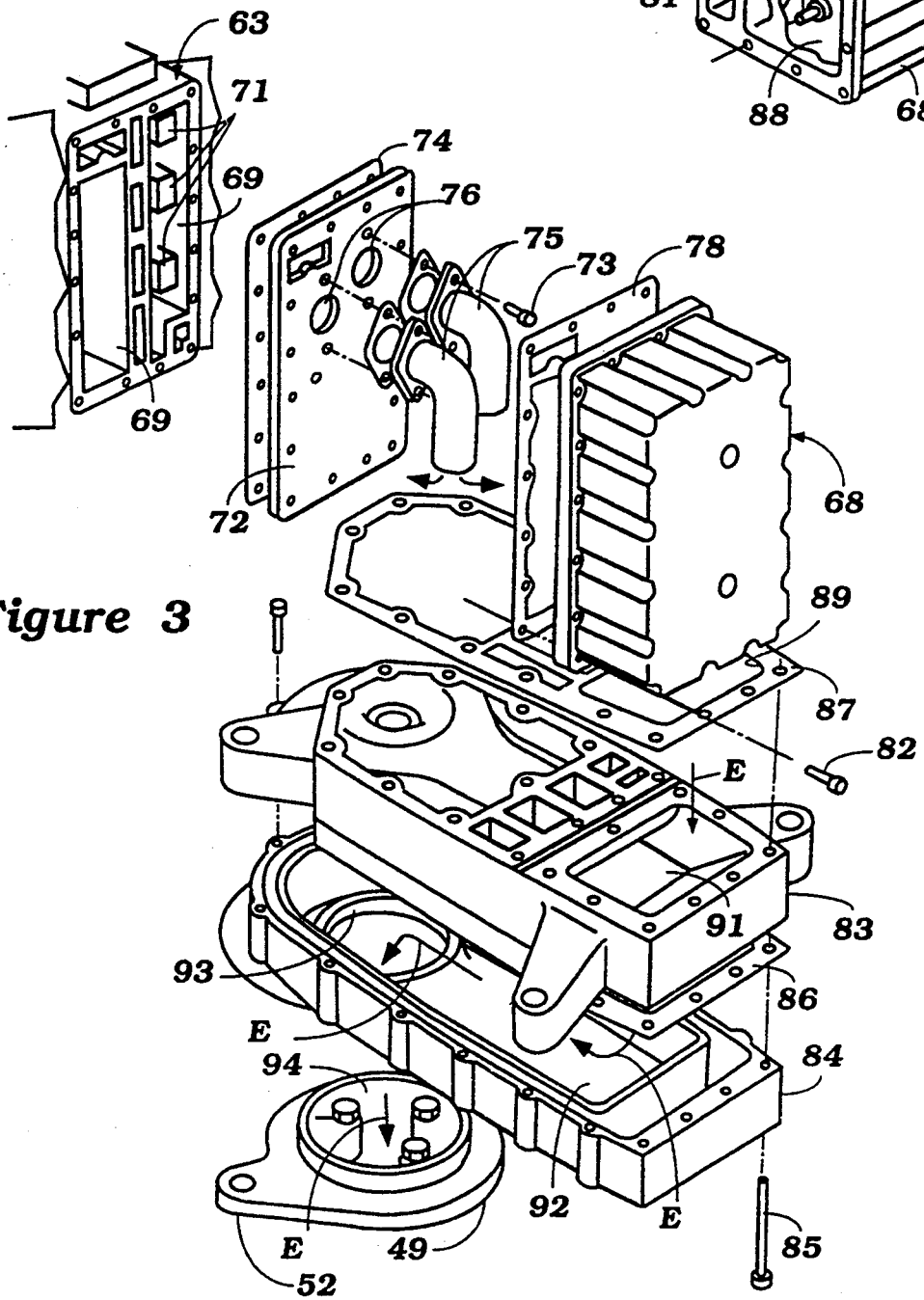
FIG. 3 is a still further enlarged exploded perspective view showing the exhaust silencing arrangement of the outboard motor.

Referring now specifically to FIGS. 3 and 4, as has been noted there are provided exhaust manifolds in the valley of the cylinder block of the engine. These exhaust manifolds are shown partially in FIG. 3 and are identified by the reference numeral 69. Exhaust gases are delivered to the exhaust manifold 69 from exhaust ports 71 formed in the cylinder liners and cylinders themselves, as is well known with this art.

A manifold closure plate 72 is affixed to the upper portion of the cylinder block to close the manifolds 69. Threaded fasteners 73 and a sealing gasket 74 complete the closure of the manifold 69.

A pair of exhaust pipes 75 are affixed to the closure plate 72 by fasteners 82 and register with respective openings 76 which permit the exhaust gases to flow from the exhaust manifold 69 into a hollow interior expansion chamber 71 formed by the silencing device 68. A further gasket 78 is interposed between a flange 79 of the exhaust silencing device and the manifold closure plate 72. The threaded fasteners 73 extend through the flange 81 and affix the silencing device 68, closure plate 72 and gasket 74 and 78 in position.

From the expansion chamber 77 the exhaust gases are discharged downwardly, as shown by the arrows "E" in FIG. 3 to a buoyant body consisting of an upper piece 83 and a lower piece 84 that are affixed to each other and to the underside of the engine 63 and exhaust silencing device 68 by means of a plurality of threaded fasteners 85. A sealing gasket 86 is interposed between the bodies 83 and 84 and a sealing gasket 87 is positioned between the body 83 and the underside of the cylinder block of the engine 63 and the exhaust silencing device 68.

The lower face of the exhaust silencing device 68 is provided with an exhaust discharge opening 88 which mates with a corresponding opening 89 in the gasket 87 and which registers with an exhaust passage 91 formed in the upper member 83. This exhaust passage 91 communicates with a hollow chamber 92, which forms a further expansion chamber between the pieces 83 and 84. The exhaust gases then exit through an opening 93 formed in the lower piece 84 which, in turn, registers with a hollow opening 94 in the steering member 49. The opening 94 permits the exhaust gases to flow downwardly into a further exhaust passage 95 formed in the upper part of the lower unit member 38 which, in turn, communicates with an exhaust discharge passageway 96 formed in the lower unit lower member 39. The exhaust passage 96 communicates with a through the hub underwater high speed propeller discharge 97.

As a result of the aforedescribed construction, it should be readily apparent that the exhaust gases are very effectively silenced by the expansion chamber silencing device 68 which is positioned in the power head and which is further silenced by flowing through the expansion chamber 92 of the buoyant mass formed by the members 83 and 84 and through its underwater exhaust discharge. Also, since the exhaust gases have been effectively silenced and cooled in the power head, the lower unit 37 may be made quite compact in size and can have very low flow resistance.

Referring again to the construction of the power head 62, in addition to the internal combustion engine 63 and buoyant body formed by the plates 83 and 84, there is provided a protective cowling which sealingly surrounds the engine 63 and is affixed to the support cradle 17 so as to provide a water tight seal, at least around the lower portion thereof. This protective cowling is comprised of a lower tray member 98 which has a generally cupped shaped configuration and which is affixed in a suitable sealing manner to the portion 25 of the cradle 17 and which extends upwardly. A cover piece 99 is detachably affixed to the tray 98 in a known manner and completes the enclosure for the engine 63. Of course, a suitable atmospheric air inlet is provided by the cowling above the water level "WL" so that air for the engine induction may be drawn into the cowling.

As may be seen in FIG. 1 when the associated watercraft 13 is operating in a non-planing condition, the water line "WL" will extend above not only the cradle portion 25 but also above the buoyant mass formed by the plates 83 and 84 and around the protective cowling portion 98. As a result, there will be a buoyant lift to the rear of the hull 13 that will assist in the watercraft achieving the planing condition. When the watercraft is planing, then only the lower unit 37 is submerged and then only partially so as to reduce the hydrodynamic drag.

It should be readily apparent from the foregoing description that the provision of the expansion chamber for the exhaust gases of the engine in the power head avoids a number of problems attended with the prior art and still provides good exhaust gas treatment. Of course, the foregoing description is that of a preferred embodiment of the invention and various changes and modifications may be made without departing from the spirit and scope of the invention, as defined by the appended claims.

We claim:

1. An outboard motor comprised of a power head comprising an internal combustion engine having at least two cylinders, each having an exhaust gas outlet formed in a body of said engine, an exhaust manifold formed in said body, each communicating with said exhaust outlets, and a lower unit depending from said power head and having a propulsion device driven by said engine for propelling an associated watercraft, an exhaust expansion chamber formed in said power head other than by said engine body and receiving exhaust gases from said engine exhaust manifold, an underwater exhaust gas discharge formed in said lower unit for discharging exhaust gases beneath the level of water in which the watercraft is operating under at least some running conditions, and means for delivering the exhaust gases from said exhaust expansion chamber of the power head to the underwater exhaust gas discharge.

2. An outboard motor as set forth in claim 1 wherein the exhaust expansion chamber is affixed to the internal combustion engine.

3. An outboard motor as set forth in claim 1 wherein the exhaust manifold opens through the body.

4. An outboard motor as set forth in claim 3 wherein the exhaust expansion chamber is affixed to the engine body in closing relationship with the exhaust manifold.

5. An outboard motor as set forth in claim 3 further including an exhaust pipe formed in the exhaust expansion chamber and communicating with the engine exhaust manifold for delivering the exhaust gases to the expansion chamber.

6. An outboard motor as set forth in claim 3 wherein the engine body has a pair of cylinder banks each of which is formed with a respective exhaust manifold for receiving exhaust gases from the respective cylinder banks and each of which exhaust manifolds has a separate opening through the respective engine cylinder banks.

7. An outboard motor as set forth in claim 6 wherein the exhaust expansion chamber is affixed to the engine body in closing relationship with the exhaust manifolds.

8. An outboard motor as set forth in claim 7 further including a pair of exhaust pipes each formed in the expansion chamber and receiving exhaust gases from respective engine exhaust manifold and delivering them to the expansion chamber.

9. An outboard motor comprised of a power head comprised of an internal combustion engine having an exhaust gas outlet and a lower unit depending from said power head and having a propulsion device driven by said engine for propelling an associated watercraft, an exhaust expansion chamber formed in said power head and receiving exhaust gases from said engine exhaust gas outlet, an underwater exhaust gas discharge formed in said lower unit for discharging exhaust gases beneath the level of water in which the watercraft is operating under at least some running conditions, said lower unit being supported as a unit for pivotal movement about a vertically extending steering axis relative to said power head, and a conduit extending from said expansion chamber to said underwater exhaust gas discharge including a section formed in said lower unit coaxially with said pivot axis.

10. An outboard motor as set forth in claim 9 wherein the propulsion device comprises a propeller and the underwater exhaust gas discharge is a through the hub exhaust.

11. An outboard motor as set forth in claim 10 wherein the engine has an exhaust manifold formed in a body thereof and from which the exhaust gas outlet extends.

12. An outboard motor as set forth in claim 11 wherein the exhaust expansion chamber is affixed to the engine body in closing relationship with the exhaust manifold.

13. An outboard motor as set forth in claim 12 further including an exhaust pipe formed in the exhaust expansion chamber and communicating the engine exhaust gas outlet for delivering the exhaust gases to the expansion chamber.

14. An outboard motor as set forth in claim 10 wherein the engine body has a pair of cylinder banks each of which is formed with a respective exhaust manifold for receiving exhaust gases from the respective cylinder banks.

15. An outboard motor as set forth in claim 14 wherein the exhaust expansion chamber is affixed to the engine body in closing relationship with the exhaust manifolds.

16. An outboard motor as set forth in claim 15 further including a pair of exhaust pipes each formed in the expansion chamber and receiving exhaust gases from respective exhaust gas outlets of the manifolds and delivering them to the expansion chamber.

17. An outboard motor comprised of a power head comprised of an internal combustion engine having an exhaust gas outlet communicating with an exhaust manifold formed in a body of said engine, a lower unit depending from said power head and having a propulsion device driven by said engine for propelling an associated watercraft, an exhaust expansion chamber formed in said power head and receiving exhaust gases from said engine exhaust gas outlet, an exhaust pipe formed in said exhaust expansion chamber and communicating said expansion chamber with said engine exhaust manifold for delivering the exhaust gases to said expansion chamber, an underwater exhaust gas discharge formed in said lower unit for discharging exhaust gases beneath the level of water in which the watercraft is operating under at least some running conditions, and means for delivering the exhaust gases from the exhaust expansion chamber of the power head to the underwater exhaust gas discharge.

18. An outboard motor as set forth in claim 17 wherein the exhaust expansion chamber is affixed to the internal combustion engine.

19. An outboard motor as set forth in claim 17 wherein the exhaust manifold opens through the engine body and from which the exhaust gas outlet extends.

20. An outboard motor as set forth in claim 19 wherein the exhaust expansion chamber is affixed to the engine body in closing relationship with the exhaust manifold opening.

* * * * *